US005655974A

United States Patent [19]

Bair

[11] Patent Number: 5,655,974

[45] Date of Patent: Aug. 12, 1997

[54] GOLF PLAYING SURFACE ASSEMBLY

[76] Inventor: Carl J. Bair, 12625 Danielson Ct., #108, Poway, Calif. 92064

[21] Appl. No.: 696,331

[22] Filed: Aug. 13, 1996

[51] Int. Cl.[6] ..... A63B 69/36

[52] U.S. Cl. ..... 473/278; 473/262

[58] Field of Search ..... 473/171, 262, 473/278, 279; 273/195 A

[56] References Cited

U.S. PATENT DOCUMENTS

| | | | |
|---|---|---|---|
| 2,790,640 | 4/1957 | Hoag | 473/278 |
| 3,414,266 | 12/1968 | Mitchell | 473/278 |
| 3,586,335 | 6/1971 | D'Antonio | 473/278 X |
| 3,633,917 | 1/1972 | Anderson | 473/279 |
| 4,150,825 | 4/1979 | Wilson | 273/185 B |
| 4,886,276 | 12/1989 | Digangi | 473/278 X |
| 5,205,562 | 4/1993 | Hammon | 473/278 |
| 5,293,660 | 3/1994 | Park | 473/278 X |

*Primary Examiner*—George J. Marlo
*Attorney, Agent, or Firm*—Brown, Martin, Haller & McClain

[57] ABSTRACT

A golf ball playing surface assembly including a playing surface having a rectangular recess of predetermined depth, length and width;

a plurality of different mats for selectively placing in the recess to simulate different playing conditions, each mat having at least one dimension less than a corresponding dimension of the recess, and whereby at least two mats placed side by side will substantially fill the recess with no gaps; and the mats including at least one mat having at least two different surface areas for simulating different golf playing surface conditions.

18 Claims, 3 Drawing Sheets

GOLF PLAYING SURFACE ASSEMBLY

BACKGROUND OF THE INVENTION

The present invention relates generally to artificial playing surfaces for use in golf ball driving ranges, golf simulators, golf ball hitting bays and the like.

Golf simulators are becoming increasingly popular for allowing players to practice their game in an indoor facility. These arrangements permit playing, training and practice regardless of outdoor weather conditions. In a typical golf simulator, a playing enclosure is provided with a full wall screen at one end onto which views of a golf course are projected. In such golf simulators, as well as in indoor golf ball hitting bays and the like, a floor area is designated for the player to hit the ball. Typically, a foam-backed hitting mat is placed on top of the floor surface in this area. Although the mat may be a carpet or other brush-like mat of short, medium or heavy weight for simulating different playing surfaces, this arrangement is not ideal since the ball hitting area is elevated above the surrounding floor surface on which the player stands, and therefore does not give a realistic feel of a real golf ball hitting environment. If putting is involved, the player must either hit off from a raised mat, which is undesirable, or move off from the main hitting area to put the ball in a level and more realistic environment. Additionally, such mats typically wear out fairly rapidly.

SUMMARY OF THE INVENTION

It is an object of the present invention to provide a golf ball playing surface assembly for more realistically simulating an actual playing environment.

According to the present invention, a golf ball playing surface assembly is provided, which comprises a playing floor for a golf simulator or other artificial golf hitting area, the playing floor having a rectangular recess of predetermined depth, and a plurality of different mats for selectively placing in the recess to simulate different playing conditions, the height of at least some of the mats being substantially equal to the depth of the recess, the recess having at least one dimension which is greater than the corresponding dimension of any one of the mats, and the mat dimensions being such that a plurality of the mats placed side by side in a selected configuration in the recess will substantially fill the recess with no gaps, the mats having different surface areas for simulating different golf playing surfaces, whereby different combinations of mats can be selectively placed in the recess to simulate a plurality of different playing surface conditions.

The mats are preferably provided in at least two different sizes, comprising a first larger size mat of height equal to the depth of the recess, whereby the upper surface of the mat is level with the surrounding floor surface, for simulating a standing/putting area, and a second, smaller size mat with a plurality of different pile or tuft depth or density areas for simulating different types of hitting surface. Preferably, three different pile areas for simulating rough, fairway and sand are provided on the second type of mat. A third type of mat of equivalent dimensions to the second mat may also be provided, in which the positions of the rough, fairway and sand areas are reversed, for use by left-handed players, for example. The dimensions of the mats are preferably such that at least one of the first size mats and two of the second or third, or one of the second and one of the third, mats are required to fill the recess. In a preferred embodiment, two of the first size mats and two of the second, third, or one second and one third mat, are required to fill the recess. This allows a large variety of different configurations. A fourth mat of the same dimensions as the second and third mats, but the same height as the first mat, may also be provided, to permit configurations in which only one or none of the second or third mats is used.

This invention provides a very large variety of easy to change playing surface configurations, in combination with a standing/putting surface which is flush with the surrounding floor surface so as to more accurately simulate putting or teeing off conditions on an actual golf course. The mats can be moved or replaced quickly and easily in order to change playing surface conditions or replace worn mats.

BRIEF DESCRIPTION OF THE DRAWINGS

A preferred embodiment of the present invention will now be described by way of example only with reference to the accompanying drawings, in which like reference numerals refer to like parts, and in which.

DESCRIPTION OF THE PREFERRED EMBODIMENTS

Figure 1:
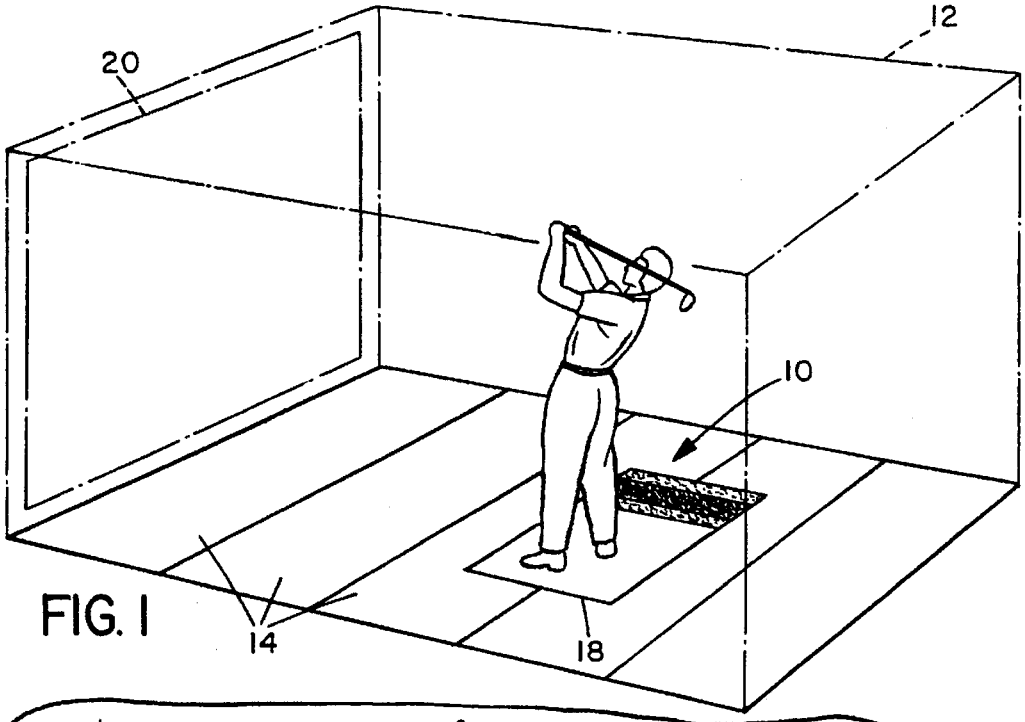
FIG. 1 is a pictorial view of a typical simulated golf installation, showing a playing surface assembly according to a preferred embodiment of the present invention.
Figure 3:
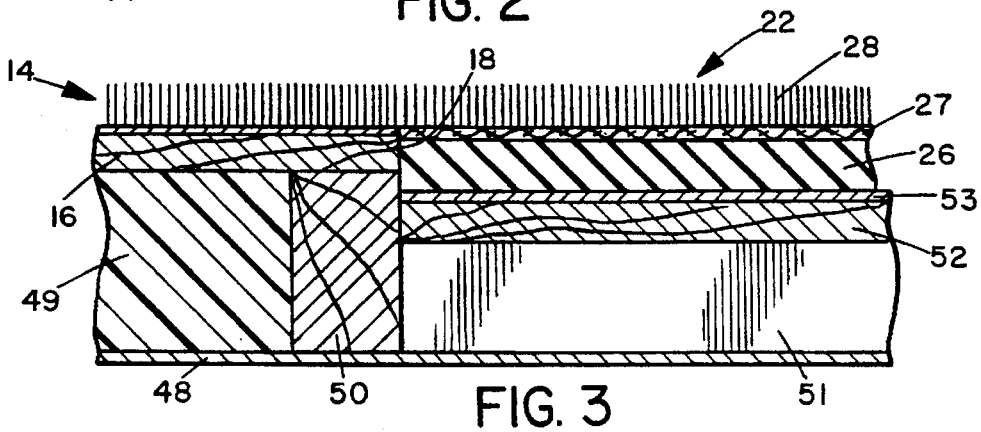
FIG. 3 is an enlarged sectional view taken on line 3—3 of FIG. 2.

FIG. 1 illustrates a playing surface assembly 10 according to a preferred embodiment of the present invention, forming part of a golf simulator 12. Although the surface assembly 10 is incorporated in a golf simulator in the illustrated embodiment, it will be understood that it may alternatively be used in other golf ball hitting areas outside of a conventional golf course, such as golf ball driving ranges and golf ball hitting bays. In a typical golf simulator or other simulated hitting area, a playing surface is formed from a series of floor panels 14 which are typically of Astroturf® or the like laid on ½" plywood flooring 16, as best illustrated in FIG. 3. A rectangular recessed area 18 is formed in the playing surface at an appropriate position corresponding to the normal hitting position of a player using the simulator, driving range or bay. In the golf simulator illustrated in FIG. 1, the recessed area 18 is formed between the third and fourth floor panels from the screen end 20 of the simulator. It will be understood that such a recessed area may be formed as desired in other playing surfaces such as cement floors or the like.

A plurality of different mats 22,23,24 and 25 defining different stance or playing surfaces are provided for selectively placing in the recessed area to form different playing surfaces 10 dependent on the desired playing conditions. Some possible configurations and mat combinations are illustrated by way of example in FIGS. 2, 4, 6 and 8.

Figure 8:
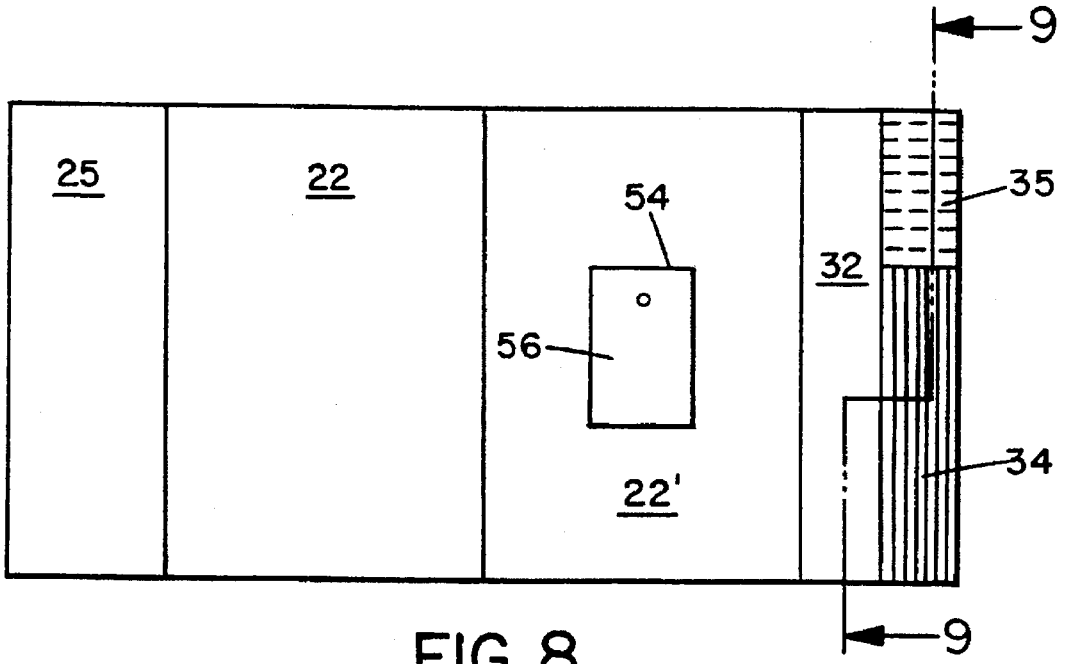
FIG. 8 is a top view of another alternative configuration.
Figure 9:
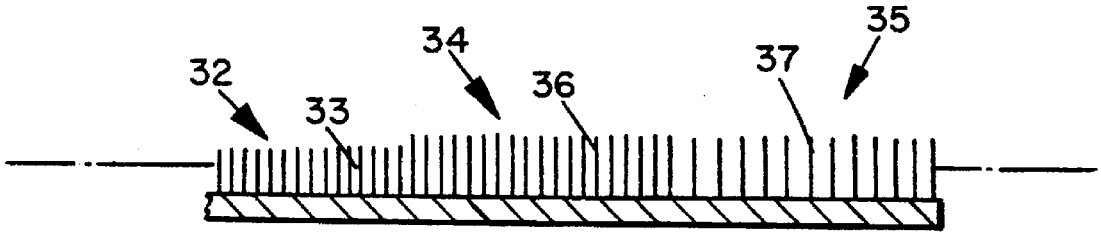
FIG. 9 is a sectional view taken along line 9—9 of FIG. 8.

However, it will be understood that various other configurations are possible. The mats 22 and 25 are preferably of foam-backed Astroturf®, although other foam-backed, carpet-like materials may alternatively be used for these mats. Mats 23 and 24 are nylon brush mats. Mats 22 and 25 have a uniform pile density and depth to simulate short grass, as in conventional Astroturf®, but the mats 23 and 24 have regions of different pile density and depth for simulating different playing conditions, as best illustrated in FIGS. 8 and 9 and described in more detail below.

Figure 2:
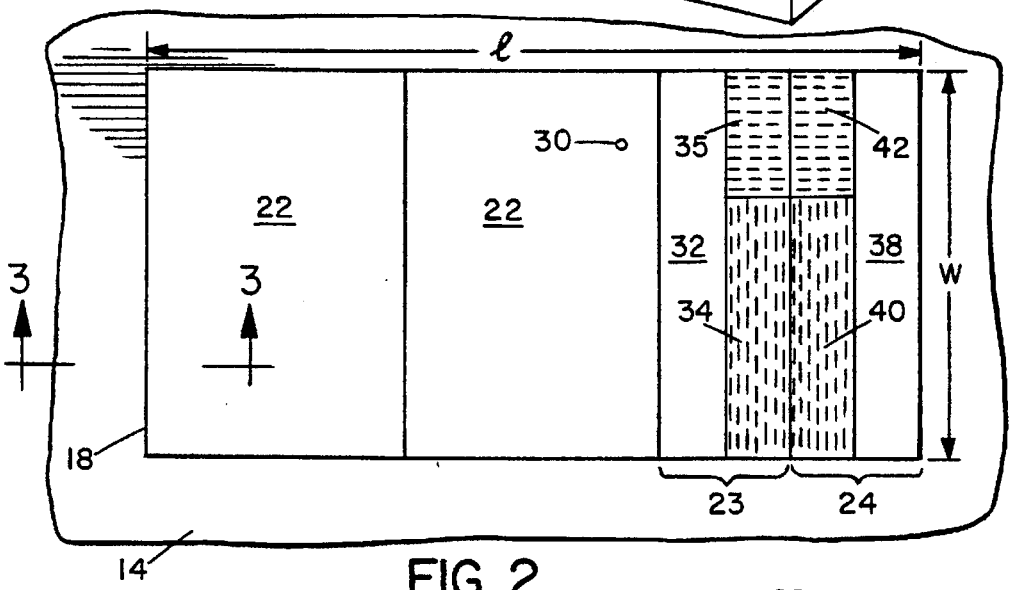
FIG. 2 is an enlarged top view of the surface assembly, showing one arrangement of the mats.

Assuming that recessed area 18 has a length l and width w, as indicated in FIG. 2, each of the rectangular mats 22,23,24 and 25 has a longer dimension or length which is equal to width w, and a shorter dimension or width which is less than dimension l. For example, if mat 22 has a width a, and mats 23,24 and 25 each have a width b, then $l=2a+2b$. Thus, a plurality of different arrangements of two of the mats 22 and any two of the mats 23,24 or 25 are possible for fitting in and covering the entire recessed area 18. Four of the many possible alternatives are illustrated in FIGS. 2, 4, 6 and 8, respectively.

Mats 22 and 25 are each brush- or carpet-like mats having a foam backing layer 26, a fiber base 27, and a tight pile 28 of a relatively low depth for simulating fairway or putting conditions, as best illustrated in FIG. 3. These are intended to be used as stance mats for the player 30 to stand on while striking the ball, as indicated generally in FIG. 1, or as a tee or putting area. However, mat 25 is narrower than mat 22, as illustrated in FIG. 8, which illustrates a combination utilizing both mats 22 and 25. The depth of recessed area 18 is designed such that when the stance mats 22 or 25 are placed in the recess, the pile 28 will be substantially flush with the pile of the surrounding floor panel surface, as indicated in FIG. 3. A golf tee 30 may be inserted through the pile 28 into the foam backing layer 26 at any desired position. Alternatively, a ball may be placed directly onto the pile to simulate putting.

Mats 23 and 24 are plastic brush mats with plastic tufts embedded in a plastic base. In each mat, regions of different pile depth and density are provided for simulating different types of playing surface. Mat 23 has a first strip 32 with brush or pile 33 of a first depth deeper than that of mats 22 and 25 and covering half of the mat surface. Strip 32 is designed to simulate fairway and will have a pile density less than that of the stance mats 22 and 25. Strip 32 is located on the left-hand side of mat 23. The other, right-hand half of the mat 23 is divided into two regions 34,35, the first of which has pile 36 of a second depth deeper than that of pile 33, and the second of which has pile 37 of equivalent depth to pile 36, but with looser fibers or reduced pile density, as best illustrated in FIGS. 8 and 9. The pile density in region 34 is less than that in strip 32, and the pile density in region 35 is less than that in region 34. The first region 34 is for simulating rough, and the second region 35, which is smaller than region 34, simulates playing in sand traps. Due to the looser pile in region 35, a ball will sit deeper into the pile in this region, providing a simulation of a sand trap. Mat 24 is similar to mat 23, but the playing regions are reversed. Thus, mat 24 has a strip 38 on the right-hand side with a pile of the same depth as pile 33 for simulating fairway, a first region 40 on the left-hand side with a pile of the same depth as pile 36 for simulating rough, and a second region 42 with a pile of the same depth as pile 37 for simulating sand. When the two mats are placed side by side with mat 23 on the left, as in FIG. 2, regions 34 and 40 combine to form a wider rough simulating area and regions 35 and 42 combine to form a wider sand simulating area. The different piles are of different depth and also of different tuft tightness for simulating the various playing conditions. Thus, mats 22 and 25 have a short, tight pile, areas 32 and 38 have a slightly deeper, looser pile, areas 34 and 40 are of heavier weight, deeper pile, and areas 35 and 42 have looser pile of the same depth as areas 34 and 40.

As best illustrated in FIG. 3, the floor of a golf simulator generally consists of ½" plywood flooring panels with 2" by 3" boards around the edges and a fiberboard base 48, with foamed material 49 between the flooring panels and base 48. The recessed area will be suitably cut at an appropriate position, and bordered with 2" by 3" boards 50 as illustrated in FIG. 3. A series of 2" by 3" boards 51 are then laid flat in the bottom of the recess, and a ½" plywood flooring panel 52 is laid on top of the boards 51. A ⅛" layer 53 of masonite is then placed on top of panel 52, forming the bottom of the recessed area. The selected mats will be placed on top of layer 53, as illustrated in FIG. 3.

As noted above, FIGS. 2, 4, 6 and 8 illustrate three possible arrangements of the mats. However, it will be understood that many other alternatives are possible simply by rearranging the mat positions and using different combinations of the six mats. In FIG. 2, two stance mats 22 are placed side by side starting at one end of recessed area 18, and mats 23 and 24 are then placed side by side to fill the right-hand end of the recessed area, with mat 23 on the left-hand side. This allows the player to tee off or putt from mats 22, which are substantially level with the surrounding floor surface, and to play the ball from a surface simulating fairway, a surface simulating rough, or a surface simulating sand. The arrangement in FIG. 2 will be particularly suitable where the player is right handed. If the player is left handed, they simply reverse the arrangement of FIG. 2 to place the mats 23,24 at the left-hand end of recessed area 18. In another alternative which is not illustrated, mats 23 and 24 may be replaced with two mats 25 to provide an all stance mat configuration. In another alternative, the mats 23,24 may be reversed, with mat 23 on the right-hand side and mat 24 on the left. This will provide an enlarged fairway area at the center, since the two strips 32 and 38 which simulate fairway conditions will be side by side.

Figure 4:
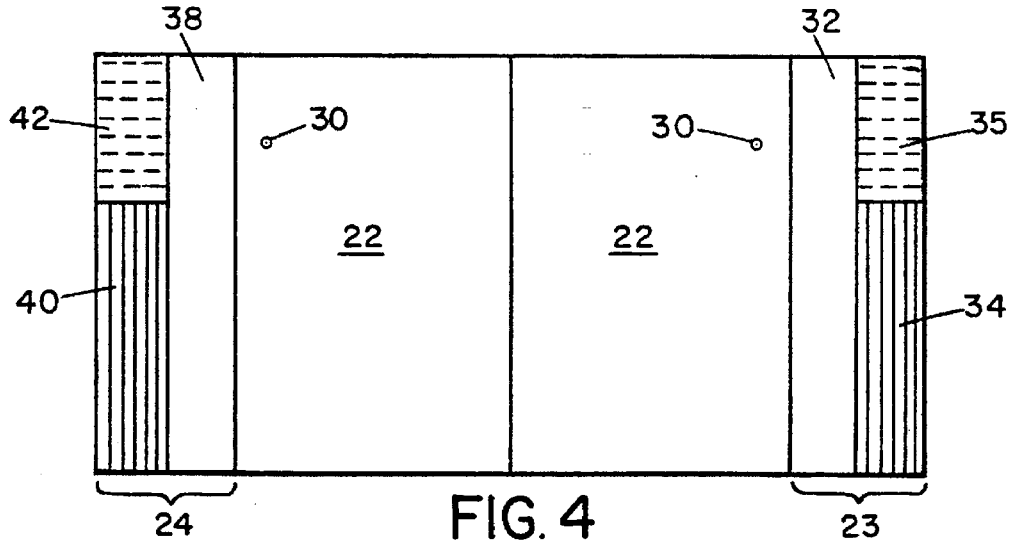
FIG. 4 is a top plan view of an alternative arrangement of the mats.
Figure 5:
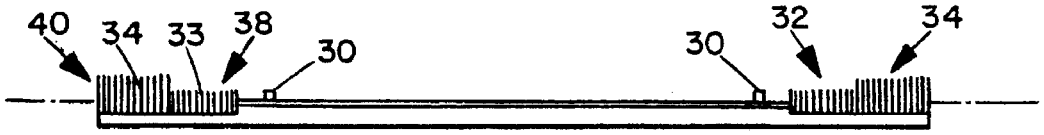
FIG. 5 is an edge view of the mats of FIG. 4.

FIGS. 4 and 5 illustrate another alternative configuration where the two stance mats 22 are placed at the center of the recessed area, with a mat 24 at the left-hand end and mat 23 at the right-hand end, when viewed in a direction facing towards the screen. This permits playing by either left- or right-handed players with the same basic mat arrangement. In an alternative arrangement, the mats 23 and 24 may be reversed, with mat 23 at the left and mat 24 at the right-hand end of the recessed area.

Figure 6:
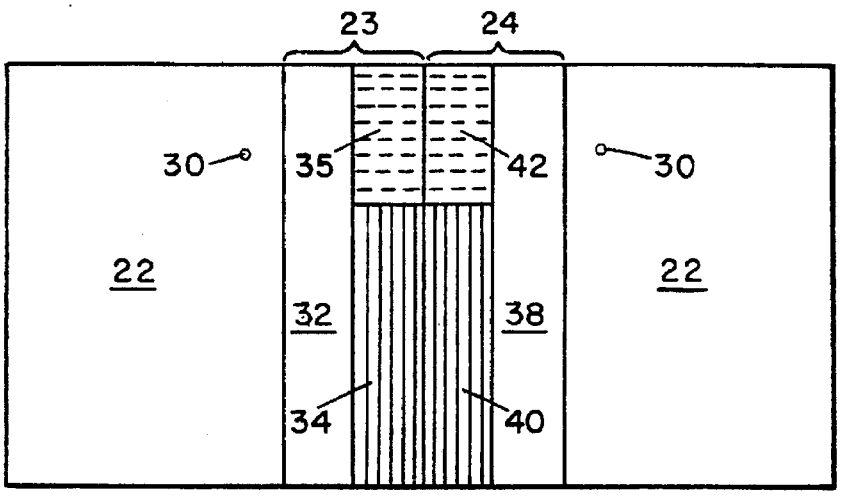
FIG. 6 is a top plan view of a further configuration of the mats.
Figure 7:
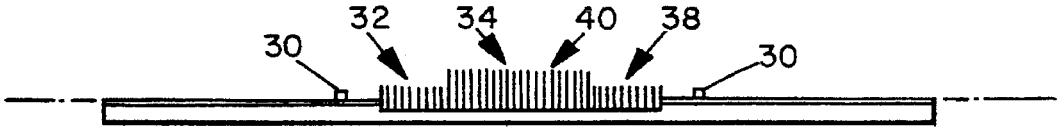
FIG. 7 is an edge view of the mats of FIG. 6.

FIGS. 6 and 7 illustrate another possible configuration of the various mats to form a different playing surface. In this configuration, two stance mats 22 are placed at opposite ends of the recess, and mats 23 and 24 are placed at the center, with the mat 23 on the left of mat 24. Again, this will permit use by both left- and right-handed players on the same playing surface, using the opposite stance mats. This configuration provides a useful basic playing surface for either-handed players, having an enlarged rough and sand area at the center of the playing surface. If desired, mats 23 and 24 may be reversed to provide an enlarged fairway area by positioning areas 32 and 38 side by side.

FIG. 8 illustrates another alternative playing surface configuration made up of one stance mat 22, a modified stance mat 22', one of the narrower stance mats 25, and mat 23. This provides an enlarged stance mat area over the previous configurations. In this alternative, one of the wider stance mats 22' is modified to provide a recess or cut-out 54 for receiving a conventional golf swing analyzer 56. Mat 22' will therefore be used whenever a player wishes to use a golf swing analyzer. The combined area of stance mats 22 and 25 may be used for the player to stand and also for a putting surface. The arrangement may be reversed for left-handed players.

It will be understood that various other configurations are possible, such as an all stance mat configuration using two stance mats 22 and two stance mats 25 to fill recessed area 18, and a configuration replacing stance mat 22' in FIG. 8 with another stance mat 22. In each case, a playing surface is provided which simulates desired playing conditions and which is substantially flush with the surrounding floor or ground area, putting the ball in a level and more realistic playing environment. The assembly provides a variety of different ball hitting locations which give a realistic feel of different ball hitting environments at different positions, depending on the selected mat combination and positions. This provides a realistic, easy to change, and easy to use ball hitting surface which may be readily used in golf ranges, hitting bays, golf game practice and golf simulators.

Although preferred embodiments of the invention have been described above by way of example only, it will be understood by those skilled in the field that modifications may be made to the disclosed embodiments without departing from the scope of the invention, which is defined by the appended claims.

I claim:

1. A golf ball playing surface assembly, comprising:

a playing surface for golf having a rectangular recess of predetermined depth, length and width;

a plurality of different mats for selectively placing in the recess to simulate different playing conditions, each mat having at least one dimension less than a corresponding dimension of the recess, and whereby at least two mats placed side by side will substantially fill the recess with no gaps; and the mats including at least one mat having at least two different surface areas for simulating different golf playing surface conditions.

2. The assembly as claimed in claim 1, wherein the mats are rectangular and each have a longer dimension equal to the width of said recess, and a shorter dimension less than the length of said recess, and the total of the shorter dimensions of a plurality of said mats placed side by side is equal to the length of said recess.

3. The assembly as claimed in claim 2, wherein the mats include first and second sets of mats having different shorter dimensions,the first set of mats having a shorter dimension which is less than the corresponding shorter dimension of the second set of mats.

4. The assembly as claimed in claim 3, wherein the total length of the shorter dimension of two mats from the first set and two mats from the second set is equal to the length of said recess.

5. The assembly as claimed in claim 1, wherein said mats include at least one first mat having a uniform pile depth and density for simulating a tee area, and at least one second mat having three areas with different piles, a first of said areas having a first pile depth for simulating fairway, a second of said areas having a second pile depth deeper than said first depth for simulating rough and a predetermined pile density, and a third, of said areas having a pile density less than that of said second area for simulating a sand trap.

6. The assembly as claimed in claim 5, including at least two of said first mats, at least one second mat, and a third mat having first, second and third areas with said first, second and third pile depths, respectively, the second and third mats having left- and right-hand side edges, and the first area being on the left-hand side of the second mat and on the right-hand side of the third mat.

7. The assembly as claimed in claim 6, wherein the first area on the second mat comprises a strip covering half of the mat on the left-hand side, and the first area on the third mat comprises a strip covering half of the mat on the right-hand side, whereby an enlarged rough simulating area is provided by placing the third mat and second mat side by side in the recess with the third mat on the left of the second mat.

8. The assembly as claimed in claim 7, wherein the second and third areas cover the opposite half of the mat to the first area, and the second area is larger than the third area.

9. The assembly as claimed in claim 6, wherein said first mat is wider than said second and third mats, and said second and third mats are of identical dimensions.

10. The assembly as claimed in claim 9, including a fourth mat of identical dimensions to said second and third mats, the fourth mat having uniform pile depth equal to the pile depth of said first mat.

11. The assembly as claimed in claim 10, wherein the recess has a length equal to the width of two of said first mats and any two of said second, third and fourth mats, whereby any combination of said first mats and two of said second, third and fourth mats may be placed side by side in any selected order to fill said recess.

12. A golf simulating apparatus, comprising:

a playing surface having a forward end, a rear end, and opposite sides;

a target area at the forward end of, the playing surface defining a playing direction towards said target area;

the playing surface having a rectangular recess of predetermined depth, length and width; and a plurality of mats for selectively placing in the recess to simulate different playing conditions, each mat having at least one dimension less than a corresponding dimension of the recess, and whereby a predetermined number of said mats placed side by side will substantially fill the recess with no gaps; and the mats including at least two different mats having different surface textures for simulating different golf playing surface conditions, at least one of said mats having at least two areas having different surface textures for simulating two different golf playing surfaces on the same mat, whereby selected mats may be placed side by side in said recess in any selected configuration to simulate different playing conditions.

13. The apparatus as claimed in claim 12, wherein said mats each have a first dimension equal to the width of said recess and a second dimension less than the length of the recess, the total of said second dimensions of said predetermined number of mats is equal to the length of said recess, and said recess is oriented with said length dimension transverse to said playing direction, whereby said predetermined number of mats may be placed side by side in said recess with said first dimension oriented substantially parallel to said playing direction.

14. The apparatus as claimed in claim 12, wherein each of said mats has a backing layer and a brush-like pile, said mats including at least one first mat having a uniform pile depth for simulating a tee area, and at least one second mat having a first pile area of a first texture for simulating fairway, a second pile area of a second texture different from said first pile area for simulating rough, and a third pile area of a third texture different from said first and second pile areas for simulating sand.

15. The apparatus as claimed in claim 14, wherein said first pile area is of a first pile depth, and said second pile area has a second pile depth greater than said first pile depth.

16. The apparatus as claimed in claim 15, wherein the second pile area has a first pile density, and the third pile area has a pile density less than the first pile density.

17. The apparatus as claimed in claim 14, wherein said second mat has a left-hand side and a right-hand side, the first pile area is located adjacent the left-hand side and the second and third pile areas are located adjacent the right-hand side.

18. The apparatus as claimed in claim 17, including at least one third mat having first, second and third pile areas of said first, second and third pile depths, respectively, and left- and right-hand side edges, wherein the locations of said first, second and third pile areas on said third mat are reversed from the corresponding pile areas on said second mat, with said first pile area on said third mat being located adjacent said right-hand side and said second and third pile areas of said third mat being located adjacent said left-hand side, whereby different areas can be enlarged by placing said second and third mats side by side with said second mat on the left or with said second mat on the right.

* * * * *